US005407110A

United States Patent [19]

Marsh, Jr.

[11] Patent Number: 5,407,110

[45] Date of Patent: Apr. 18, 1995

[54] STRAP SUSPENSION FOR CONTAINERS

[76] Inventor: John R. Marsh, Jr., 8208 Noland Rd., Lenexa, Kans. 66215

[21] Appl. No.: 214,196

[22] Filed: Mar. 17, 1994

[51] Int. Cl.[6] ..... A45F 5/00

[52] U.S. Cl. ..... 224/148; 224/250; 224/257; 224/205; 224/901

[58] Field of Search ..... 224/148, 202, 205, 206, 224/257, 258, 901, 250; 294/149, 150, 157

[56] References Cited

U.S. PATENT DOCUMENTS

| | | | |
|---|---|---|---|
| 417,220 | 12/1889 | Bell | 224/148 |
| 2,550,554 | 4/1951 | Griffin . | |
| 2,733,845 | 2/1956 | Biro . | |
| 3,820,695 | 6/1974 | Pecjak | 224/148 |
| 4,096,977 | 6/1978 | Barville et al. . | |
| 4,127,223 | 11/1978 | Uchin | 224/257 X |
| 4,629,153 | 12/1986 | Marcum | 248/558 |
| 4,790,462 | 12/1988 | Kawaguchi | 224/202 X |
| 4,871,597 | 10/1989 | Hobson | 224/148 X |
| 4,993,611 | 2/1991 | Longo | 224/148 |
| 5,147,079 | 9/1992 | Heather | 224/148 |
| 5,167,354 | 12/1992 | Cohanfard | 224/148 |

FOREIGN PATENT DOCUMENTS

| | | | |
|---|---|---|---|
| 9210960 | 7/1992 | WIPO | 224/202 |

OTHER PUBLICATIONS

*The Wall Street Journal,* Marketplace, "Inside Santa's Bag: Some Bizarre Gifts", Nov. 23, 1993, p. B1.

*Primary Examiner*—J. Casimer Jacyna

*Attorney, Agent, or Firm*—Litman, McMahon & Brown

[57] ABSTRACT

A neck strap suspension is provided for beverage containers which are received in insulated holders. The strap suspension includes a neck strap assembly and upper and lower girth strap assemblies connected thereto in vertically-spaced relation. The girth strap assemblies include fasteners for securing same in closed positions. The girth strap assembly fasteners are selectively releasable for placing the girth strap assemblies in open configurations.

8 Claims, 1 Drawing Sheet

STRAP SUSPENSION FOR CONTAINERS

BACKGROUND OF THE INVENTION

1. Field of the Invention

The present invention relates generally to wearable suspensions for containers, and in particular to a neck suspension for containers in insulated holders.

2. Description of the Related Art

Various types of vessels and containers have heretofore been devised for facilitating the consumption of different types of beverages in a wide range of situations. Beverages in closed containers, such as cans and bottles, are currently very popular. Such pre-packaged beverages offer convenience and portability.

Insulated holders are a common accessory for beverage containers. A typical container holder comprises a resilient, insulating material, such as foam rubber. Such holders can provide insulation for maintaining beverage temperatures for longer periods than would be possible with uninsulated containers in ambient conditions. Such holders can also protect a container, such a glass bottle, against breakage.

After a beverage container is opened, a certain degree of care of must normally be exercised to avoid spilling the contents. However, holding an open beverage container can be inconvenient in some circumstances, such as those wherein a person is engaged in sports or other physical activity. In spite of the inconvenience, persons engaged in physical activity often prefer to have a beverage close at hand for replenishment of lost fluids, etc. For example, persons engaged in cycling, canoeing, rafting, fishing and other sports may benefit from the availability of a beverage without the hinderance of having to hold its container. Moreover, persons engaged in manual labor of various types may benefit from the availability of a beverage, particularly if a no-hands suspension is available for the beverage container which would minimize interference with the task at hand.

Previous devices which addressed this problem include those disclosed in the Griffin U.S. Pat. No. 2,550,554; the Barville et al. U.S. Pat. No. 4,096,977; the Longo U.S. Pat. No. 4,993,611 and the Cohanfard U.S. Pat. No. 5,167,354.

However, heretofore there has not been available a strap suspension for containers with the advantages and features of the present invention.

SUMMARY OF THE INVENTION

In the practice of the present invention, a wearable neck strap suspension is provided for containers in insulated holders. The suspension includes a length-adjustable neck strap assembly. Upper and lower girth strap assemblies are fastened to the neck strap assembly and define therewith a receptacle adapted to receive a container within a holder. The girth strap assemblies have open and closed configurations for retaining and releasing the containers within holders in the receptacle. The girth strap assemblies include releasable fasteners for altering their configurations between opened and closed.

OBJECTS AND ADVANTAGES OF THE INVENTION

The principal objects and advantages of the present invention include: providing a strap suspension for containers; providing such a suspension which is wearable; providing such a suspension which is adapted for receiving containers within insulated holders; providing such a suspension which is adapted for suspending a container on a wearer while leaving his or her hands free; providing such a suspension which is adapted for suspending a container on a wearer in a convenient position; providing such a suspension which is adjustable to accommodate various wearers and various containers and holders; providing such a suspension which can be easily manufactured from a variety of materials; providing such a suspension which facilitates various activities; and providing such a suspension which is economical to manufacture, efficient in operation, capable of a long operating life and particularly well adapted for the proposed use thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
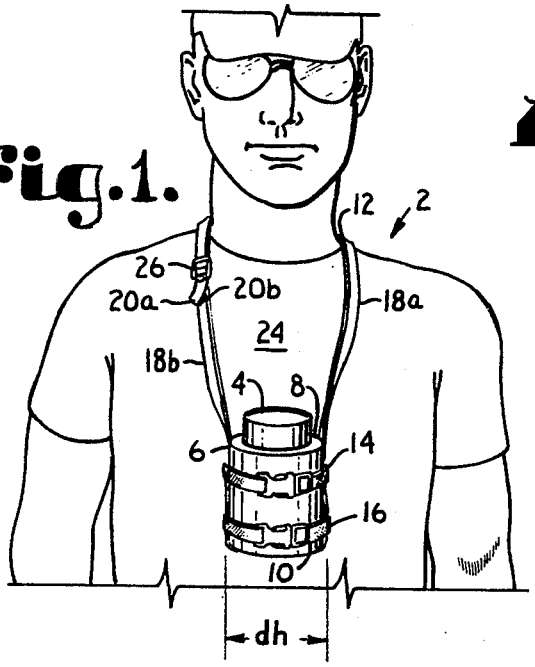
FIG. 1 is a frontal perspective view of a strap suspension embodying the present invention, shown with a container and an insulated holder receiving same and suspended from the neck of a wearer.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a strap suspension for a container 4 and a container holder 6 which receives same. The container 4 can comprise cans, bottles, cartons, etc. of various sizes and configurations. The container holder 6 likewise can assume various sizes and shapes. Without limitation on the generality of useful container holders, the holder 6 can have a generally tubular configuration with an open top 8 and a bottom 10 which is at least partially enclosed. The holder 6 can comprise a suitable compressible, insulating material, such as foam rubber. The holder 6 has an un-compressed diameter dh. Such holders are well known in the art and are generally adapted to receive a beverage container, such as a can or bottle, in a relatively secure engagement.

The suspension 2 generally consists of a neck strap assembly 12 and upper and lower girth strap assemblies 14, 16 respectively.

II. Neck Strap Assembly 12

The neck strap assembly 12 includes first and second neck strap sections 18*a*, 18*b* with respective upper ends 20*a*, 20*b* and lower ends 22*a*, 22*b*. The first neck strap section 18*a* is longer than the neck strap section 18*b* whereby the neck strap upper ends 20*a*, 20*b* will normally intersect at a location near the wearer's upper chest 24. A slide-type fastener or buckle 26 is fixedly mounted on one of the strap section upper ends 20*a*, 20*b* and slidably receives the other strap section 18*a*, 18*b* adjacent to the upper end 20*a* or 20*b* thereof whereby the neck strap assembly 12 is length-adjustable.

The neck section lower ends 22*a*, 22*b* are releasably connected by suitable fastening means, such as a hook-and-loop fastener 28 comprising a hook portion 30 on one of the neck section lower ends 22 and a loop portion 32 on the other neck section lower end 22*a*, 22*b*.

III. Girth Strap Assemblies 14, 16

Figure 2:
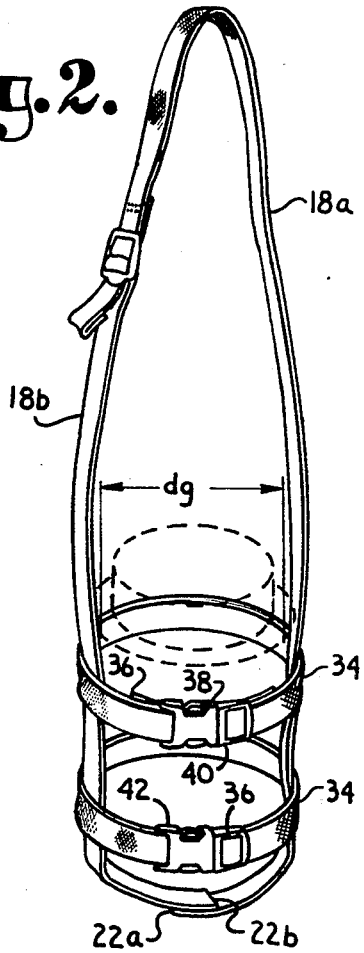
FIG. 2 is a frontal perspective view of the suspension with a container and insulated holder therefor shown in phantom lines.
Figure 3:
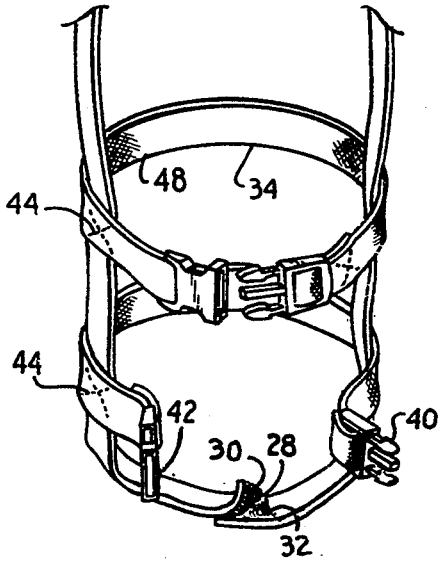
FIG. 3 is a fragmentary, upper, frontal perspective view of the suspension, showing girth strap assemblies thereof in their open configurations.

Each girth strap assembly 14, 16 includes a girth strap 34 with opposite ends 36. A bayonet-type fastener 28 includes male and female sections 40, 42 which are engageable in a fastener closed configuration (FIG. 2) and disengageable in a fastener open position (FIG. 3).

The neck strap assembly 12 is attached to the girth strap assemblies 14, 16 by suitable fastening means 44, such as the cross-stitching 44 shown. Each girth strap assembly 14 is thus fastened to the neck strap assembly 12 by a pair of fastening means which are located at locations which are generally diametrically opposite each other with the respective girth strap assembly 14, 16 in its closed configuration.

With the girth strap assemblies 14, 16 in their closed positions, each defines a diameter dg which is less than the uncompressed diameter dh of the folder 6. The girth strap assemblies 14, 16 can thus be sized to securely retain the holder 6 and the container therein. This cooperation between the girth strap assemblies 14, 16 and the holder 6 could also be achieved by providing the girth strap assemblies with length-adjusting buckles.

The girth strap assemblies 14, 16 and the lower portion of the neck strap assembly 12 form an open-top receptacle 48 for the holder 6. The receptacle 48 can be opened by opening the fasteners 38 and thereby placing the girth strap assemblies 14, 16 in their respective open positions, and also by disengaging the hook-and-loop fastener 28 to downwardly open the receptacle 48. The depth of receptacle 48 can be adjusted by means of a hook-and-loop fastener 28 which permits adjusting the length of the neck strap assembly 12 below the lower girth strap assembly 16.

When worn as shown in FIG. 1, the strap suspension 2 places a container 4 within easy reach, but leaves the wearer's hands free for various activities.

IV. Operation

In operation, the strap suspension 2 is adjustable to accommodate various containers 4 and holders 6 therefor. Since many such container holders 6 comprise a compressible material such as foam rubber, the girth strap assemblies 14, 16 can have fixed diameters dg and, by compressing the holders 6, accommodate holders 6 with diameters dh, thereby securely retaining the containers 4 and the holders 6.

The neck strap assembly 12 is length-adjustable above the upper girth strap assembly 14 by means of the buckle 26.

V. First Modified Embodiment

Figure 4:
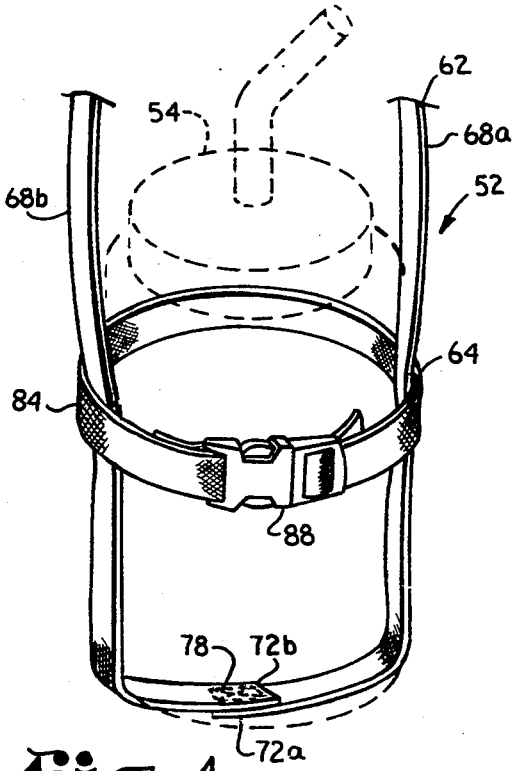
FIG. 4 is a fragmentary, upper, frontal perspective view of a strap suspension for containers comprising a first modified or alternative embodiment of the present invention; a container therein is shown in phantom lines.

A strap suspension 52 for a container 54 is shown in FIG. 4 and comprises a modified or alternative embodiment of the suspension 2. The suspension 52 includes a single girth strap assembly 64 with a length-adjustable bayonet-type fastener 88 for length-adjusting a girth strap 84. A neck strap assembly 62 is fastened together at lower ends 72*a*, 72*b* of neck strap sections 68*a*, 68*b* thereof by cross-stitching 78.

Other than the alternative features shown and described, the strap suspension 52 can be constructed and operated in a manner similar to the strap suspension 2. Moreover, features of the strap suspension 2 could be incorporated in the strap suspension 52 and vice-versa.

It is to be understood that while certain forms of the present invention have been illustrated and described herein, it is not to be limited to the specific forms or arrangement of parts described and shown.

What is claimed and desired to be secured by Letters Patent is as follows:

1. A strap suspension for containers, which comprises:

(a) a neck strap assembly including first and second sections which are generally laterally spaced from each other with the strap suspension in a use position, each said neck strap section having upper and lower ends; said neck strap assembly having a buckle interconnecting said neck strap sections adjacent to the upper ends thereof, and said buckle including length-adjusting means for length-adjusting said neck strap assembly;

(b) a girth strap assembly with opposite ends, said girth strap assembly being fixedly connected to each said neck strap section intermediate the respective upper and lower ends thereof;

(c) releasable fastening means for selectively fastening said girth strap ends, said girth strap assembly having a closed configuration with said fastening means fastened and an open configuration with said fastening means unfastened; and (d) said neck strap lower ends being connected in a vertically spaced relation to each other and below said girth strap assembly whereby said girth strap assembly and said neck strap sections below said girth strap assembly form an upwardly-open, container-receiving receptacle.

2. The strap suspension according to claim 1, which includes:

(a) said neck and girth strap assemblies including straps comprising nylon.

3. The strap suspension according to claim 1, which includes:

(a) said neck and girth strap assemblies being sewn together.

4. The invention according to claim 1, which includes:

(a) said girth strap assembly comprising an upper girth strap assembly; and (b) a lower girth strap assembly including opposite ends, said lower girth strap assembly being connected to said neck strap assembly in spaced relation below said upper girth strap assembly.

5. The strap suspension according to claim 1 which includes:

(a) said neck strap section lower ends being located at the bottom of said container receptacle; and (b) a hook-and-loop strap fastener having one of a hook portion mounted on one of said neck strap section lower ends and a loop portion mounted on the other of said neck strap section lower ends.

6. The strap suspension according to claim 1 wherein:

(a) one of said neck strap sections is longer than the other said neck strap section.

7. In combination with a container holder having a generally tubular configuration with an open top and a bottom which is at least partially closed, said container holder comprising a compressible insulating material and having an uncompressed diameter, the improvement of a strap suspension which comprises:

(a) a neck strap assembly including:

(1) first and second neck strap sections, said first neck strap section having a greater length than said second neck strap section;

(2) each said neck strap section having upper and lower ends;

(3) a hook-and-loop fastener comprising a hook portion mounted on one of said neck strap section lower ends and a loop portion mounted on the other of said neck strap section lower ends whereby said neck strap section lower ends are selectively, length-adjustably attachable to each other;

(4) a buckle fixedly attached to one of said neck strap section upper ends and length-adjustably connectable to the other of said neck strap section upper ends;

(b) upper and lower girth strap assemblies, each comprising:

(1) a girth strap with opposite ends;

(2) a bayonet-type fastener having a female portion attached to one of said girth strap ends and a male portion attached to the other of said girth strap ends;

(3) each said bayonet-type fastener having opened and closed configurations with said girth strap ends respectively connected and disconnected; and (4) said girth strap assembly having a diameter less than the diameter of said container holder with said bayonet-type fastener in its closed configuration; and (c) strap attachment means for attaching said neck strap sections intermediate the upper and lower ends thereof at diametrically-opposed locations on said upper and lower girth straps with said upper girth strap being positioned in spaced relation above said lower girth strap.

8. A strap suspension for containers, which comprises:

(a) a neck strap assembly including first and second sections which are generally laterally spaced from each other with the strap suspension in a use position, each said neck strap section having upper and lower ends; said neck strap assembly having a buckle interconnecting said neck strap sections adjacent to the upper ends thereof, and said buckle including length-adjusting means for length-adjusting said neck strap assembly;

(b) a girth strap assembly with opposite ends, said girth strap assembly being connected to each said neck strap section intermediate the respective upper and lower ends thereof;

(c) releasable fastening means for selectively fastening said girth strap ends, said girth strap assembly having a closed configuration with said fastening means fastened and an open configuration with said fastening means unfastened;

(d) said neck strap lower ends being connected in spaced relation below said girth strap assembly whereby said girth strap assembly and said neck strap sections below said girth strap assembly form an upwardly-open, container-receiving receptacle;

(e) said neck strap section lower ends being located at the bottom of said container receptacle; and (f) a hook-and-loop strap fastener having one of a hook portion mounted on one of said neck strap section lower ends and a loop portion mounted on the other of said neck strap section lower ends.

* * * * *